United States Patent [19]

Bruns et al.

[11] Patent Number: 4,556,459

[45] Date of Patent: Dec. 3, 1985

[54] SEALING ARRANGEMENT AT COKE OVEN CHAMBERS

[75] Inventors: Engelbert Bruns, Recklinghausen; August Lucas, Datteln-Horneburg, both of Fed. Rep. of Germany

[73] Assignee: Firma Carl Still GmbH & Co. KG, Fed. Rep. of Germany

[21] Appl. No.: 603,115

[22] Filed: Apr. 23, 1984

[30] Foreign Application Priority Data

Apr. 23, 1983 [DE] Fed. Rep. of Germany ..... 3314850

[51] Int. Cl.[4] ..... C10B 27/04

[52] U.S. Cl. ..... 202/263; 202/269; 414/212

[58] Field of Search ..... 202/263, 269; 414/212

[56] References Cited

U.S. PATENT DOCUMENTS

| | | | |
|---|---|---|---|
| 3,933,595 | 1/1976 | Gordon et al. | 202/263 |
| 4,312,713 | 1/1982 | Mayer et al. | 202/263 |
| 4,347,105 | 8/1982 | Kwasnik et al. | 202/269 |

FOREIGN PATENT DOCUMENTS

| | | | |
|---|---|---|---|
| 2021863 | 12/1971 | Fed. Rep. of Germany . | |
| 2821169 | 7/1979 | Fed. Rep. of Germany | 202/263 |
| 2825373 | 12/1979 | Fed. Rep. of Germany | 414/212 |
| 2943319 | 5/1980 | Fed. Rep. of Germany | 202/263 |
| 2432040 | 3/1980 | France | 202/263 |

*Primary Examiner*—Jay H. Woo
*Assistant Examiner*—M. McGurk
*Attorney, Agent, or Firm*—McGlew and Tuttle

[57] ABSTRACT

A sealing arrangement at coke oven chambers, for gas-tightly sealing the junction gaps between a transfer means, such as provided on coke guide cars or at the pushing machine and the coke oven, comprises sealing sheets at the oven side, which in operating position, apply against the outside of the chamber opening. The inner space of this transfer means is connected to stationary exhausters, for example. The sealing sheets comprise a plurality of individual segments which, as the transfer means is put in place, are pressed by adjustable springs acting through sliding rods against anchor posts and, at the top of the chamber opening against plates connected between the anchor posts at the top of the chamber.

4 Claims, 3 Drawing Figures

SEALING ARRANGEMENT AT COKE OVEN CHAMBERS

FIELD AND BACKGROUND OF THE INVENTION

The invention relates in general to coke ovens and in particular to a new and useful sealing arrangement at coke oven chambers.

An arrangement for sealing a coke guide relative to the coke oven is known from German Pat. No. 20 21 863. The reference provides a dust proof connection between the coke guide, and the coke oven and the exhaust hood, by means of elastic sealing strips. At the inlet side of the coke guide, a holding sheet is tightly secured to the outside, and a resilient sealing sheet protruding outwardly and in the direction of the oven battery is fixed thereto, with, in an operating position, the outer edges of the sealing sheets applying against the outside of the respective anchor posts bounding the oven chamber. Such resilient sealing sheets have a limited range of springiness and frequently are bent permanently upon an extreme deflection. This may lead to insufficient sealing, especially if the anchor posts of the battery become misaligned as a result of unequal expansions of the individual oven chambers.

SUMMARY OF THE INVENTION

The invention is directed to an improved sealing between coke oven chambers and a coke transfer means, so as to obtain a satisfactory sealing at all coke ovens if very wide gaps occur. In accordance with the invention a sealing arrangment for a coke oven chamber for gastightly sealing the junction gaps between a transfer device in the form of a coke cake guide car or a pushing machine in the coke oven chamber comprises sealing sheets associated with the transfer device at its oven end adapted to apply against the outside of the oven chamber opening. The transfer device has an inner space which is adapted to be connected to an exhauster at the end adjacent the oven sealing sheets which comprise a plurality of individual segments. The sheets are adapted to seal against an anchor post adjacent each side of the opening and the oven frame or armor plates between the frame and the anchor posts on the top and bottom of the opening. When the transfer device is in an operating position, the sealing sheets are pressed by adjustable tension springs which act through actuating rods against the anchor post. The springs also press the sealing sheet at the top of the oven chamber opening against the oven frame or the armor plates which are located between the anchor post on each side of the frame.

The inventive provision of individual segments makes it possible to obtain a tight contact of the sealing sheets along the entire sealing line, even if this line is distorted. Even with extreme gaps, the necessary contact pressure is produced by means of the adjustable tension springs, without causing deformations. At the top of the oven chamber, the respective gaps between the anchor posts are substantially completely sealed off by pressing the sealing sheets against the oven frame or the armor plates. With tension springs attached laterally of the actuating rods, an unusually long range of resilient action and a correspondingly long displacement of the sealing sheets relative to the transfer means is ensured.

The tension springs are advantageously biased by clamps which are displaceably supported on the actuating rods. The springs and the associated actuating rods are mounted on holding plates which can be adjustably positioned relative to the transfer device in a longitudinal direction of the oven by means of oblong slots.

The position of the sealing sheets can be adjusted to be able to move the transfer means in a retracted position along the entire battery without interfering with any of the anchor posts which may be bent differently. That is, the sealing sheets can be adjusted to the anchor post which is bent out the most.

The extension of the tension springs laterally of the actuating rods causes a certain torque by which the rear end of the actuating rod is pulled outwardly and the front or oval end thereof inwardly. The spring thus forces the sealing sheet not only toward the anchor post but also inwardly, against the slide surface of the sealing plate, so that a satisfactory sealing is obtained in that area.

Further, with a tension spring cooperating with each actuating rod associated with each sealing sheet and each holding plate it is possible, if needed, to position the sealing surface of a sealing sheet slightly obliquely. This provides for a satisfactory sealing even in instances where the sealing surface of the anchor post is warped.

To ensure a satisfactory sealing between the fixed part of a transfer car and the part thereof movable into operating position, the invention provides that in the operating position, a resilient sealing diaphragm is pressed against a wedge-shaped contact piece. Any emission within the inventive sealing arrangement and within the fixed part of the transfer car can be exhausted through a hood which is gastightly secured to this fixed part, into a stationary dust separator, for example. A simple resilient sealing diaphragm will do, since while the sealing sheets are movable within a wide range to span the sometimes considerable distance to the oven chamber surface, the relative motion between the movable part and the fixed part of the transfer car is very small.

Accordingly, it is an object of the invention to provide an improved sealing device for facilitating the transfer of coke cake from the coke oven chambers.

A further object of the invention is to provide a sealing arrangement which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
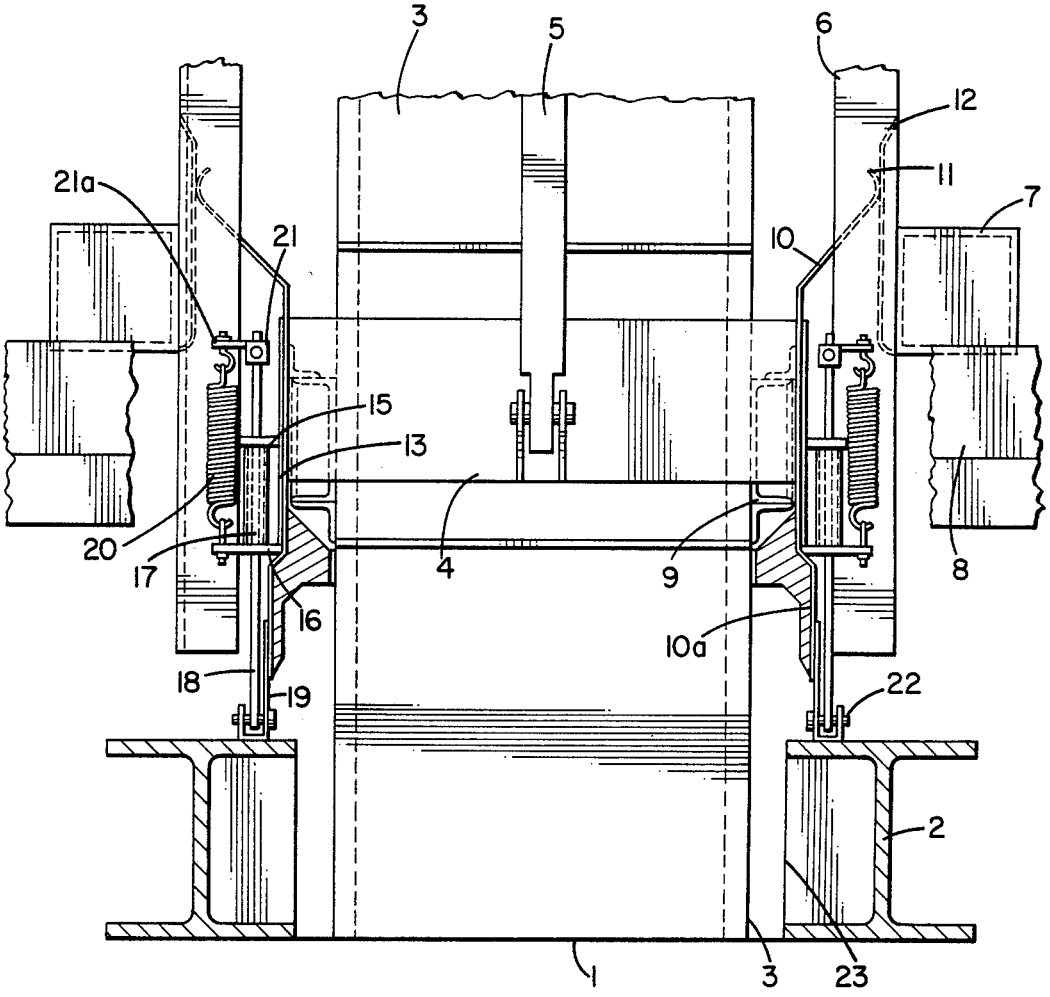
FIG. 1 is a horizontal sectional view of the inventive sealing arrangement for a coke oven taken along the line I—I of FIG. 2.

Referring to the drawings in particular the invention embodied therein comprises a sealing arrangement for access openings of coke oven chambers which have a coke transfer device such as a coke oven guide car 6 which has sealing sheets or a single sheet 19 which applies against the coke oven around the opening. In the embodiments shown, the opening of the coke oven includes an outer edge 1 arranged between two vertically extending anchor posts 2, 2. The sealing sheet 19 is applied at the sides against the anchor post and it advantageously slides on a slide sheet 10*a* (126 in FIG. 3). For this purpose, sheet 19 has one leg extending parallel to an outer surface of each post 2, and another leg extending at an angle to the first and sliding against sheet 10*a*. The construction includes an upper cover sheet such as the sheet 124 shown in the FIG. 3 embodiment which carries a holding plate 113 which is advantageously adjustably positioned by means of a securing bolt 123 engaged in a longitudinally extending slot 114. Actuating rod guide means are provided for an actuating rod 18 in the FIG. 1 and 2 embodiment, and they advantageously comprise rear and front webs 15 and 16 which project outwardly from a sealing plate or holding plate 10 and support a guide tube 17 for the guide rod 18 which is secured at its opposite end by a clamp 21 and is articulated at its front end by a retaining bolt 22 secured to the sealing sheet 19. Spring means 20 are provided between the clamp 21 carried at the rear end of the rod 18 and the front web 16 in the form of a spring 20 which urges the sealing sheet into engagement with the anchor post.

FIG. 1 shows the substantial elements of the inventive sealing arrangement in an operating position in which the transfer means, namely a coke guide 3 in this example, which has been moved by power cylinders 5 against the outer edge 1 of the coke oven chamber, applies its metallic sealing sheets 19 against the outer surface of anchor post 2. The coke guide 3 of itself is not gastight and its connection to the circumference of the oven chamber opening is not gastight either, so that an additional gastight enclosure sealing the coke guide against the outer atmosphere must be provided. In the shown embodiment, the additional enclosure is formed on each side by the anchor post 2, the sealing sheet 19, sealing plates 10, a resilient sealing diaphragm 11, a contact piece 12, and the only indicated outer wall 6 of the guide car or transfer car. Depending on the section of the anchor post 2, a lining 23 may be provided at the inside thereof, to reduce the gap around the upper horizontal sealing sheets 124, 119 to a minimum. Since the transfer car must be positioned relative to the oven in every instance very accurately, the gap above thus remains very small.

Coke guide 3 is framed outside by vertical steel sections 9 and an upper cross member 4 against which the power cylinder 5 is applied. The transfer car comprises, among others, vertical braces 7 and an upper horizontal beam 8. In operating position, the seal at the car side is formed by a resilient diaphragm 11 applying against contact piece 12. Contact piece 12 is fixed to vertical brace 7. Both contact piece 12 and the individual elements of resilient sealing diaphragm 11 extend over the entire height of the outer wall of the transfer car 6. Resilient sealing diaphragm 11 is secured to sealing plate 10. Sealing plate 10 is secured to vertical steel section 9, and protrudes toward the oven by a portion having a slide surface 10*a* which extends in the axial direction of the oven. Sealing sheet 19 is mounted for being displaceable in the axial direction of the oven on the slide surface 10*a* of the sealing plate 10 and is pressed against this surface 10*a* by a mechanism comprising an actuating rod 18 movable in a guide tube 17 supported between cross webs 15 and 16 and engaged by a clamp 21 with a lever arm 21*a*, and biased by a tension spring 20. Due to a torque produced by the spring 20 and lever arm 21*a*, sealing sheets 19 can be moved in the direction of slide surfaces 10*a* to a limited extent by a play of actuating rod 18 in cross webs 15,16. The fulcrum for the slight pivoting of actuating rod 18 with the sealing sheet 19 is about the front web 16 which is closer to the oven.

Figure 2:
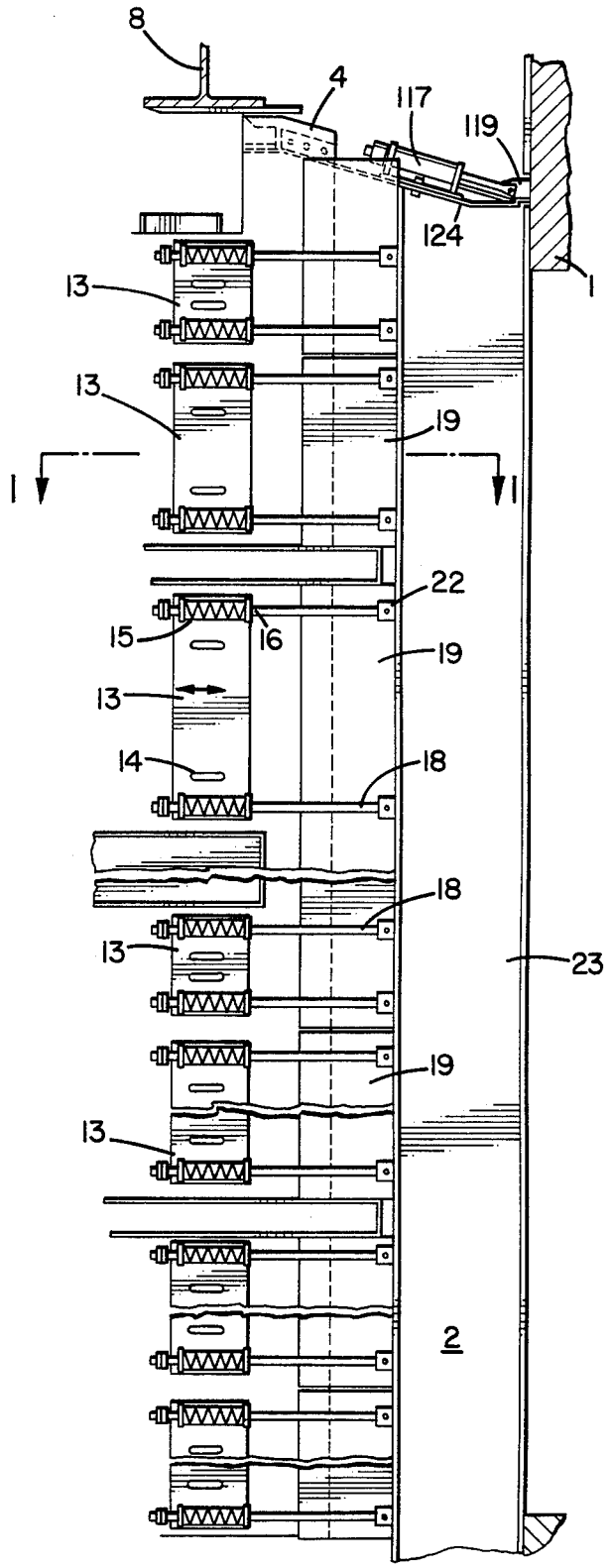
FIG. 2 is a partial vertical side view of the inventive arrangement, showing the sealing sheets in contact with the sealing surface of the anchor post and the normal plates of the oven.

FIG. 2 shows a holding plate 13 on which rear cross web 15 and front cross web 16 are supported. Plates 13 are displaceable in the longitudinal direction of the oven. For this purpose they are provided with oblong slots 14. Each plate 13 is connected to sealing plate 10 at two locations and carries two tension springs 20 and associated, mutually parallel actuating rods 18 which are connected by their front ends through retaining bolts 22 each to a sealing sheet 19. FIG. 2 shows all the sealing sheets 19 applied against the front surface of anchor post 2.

Figure 3:
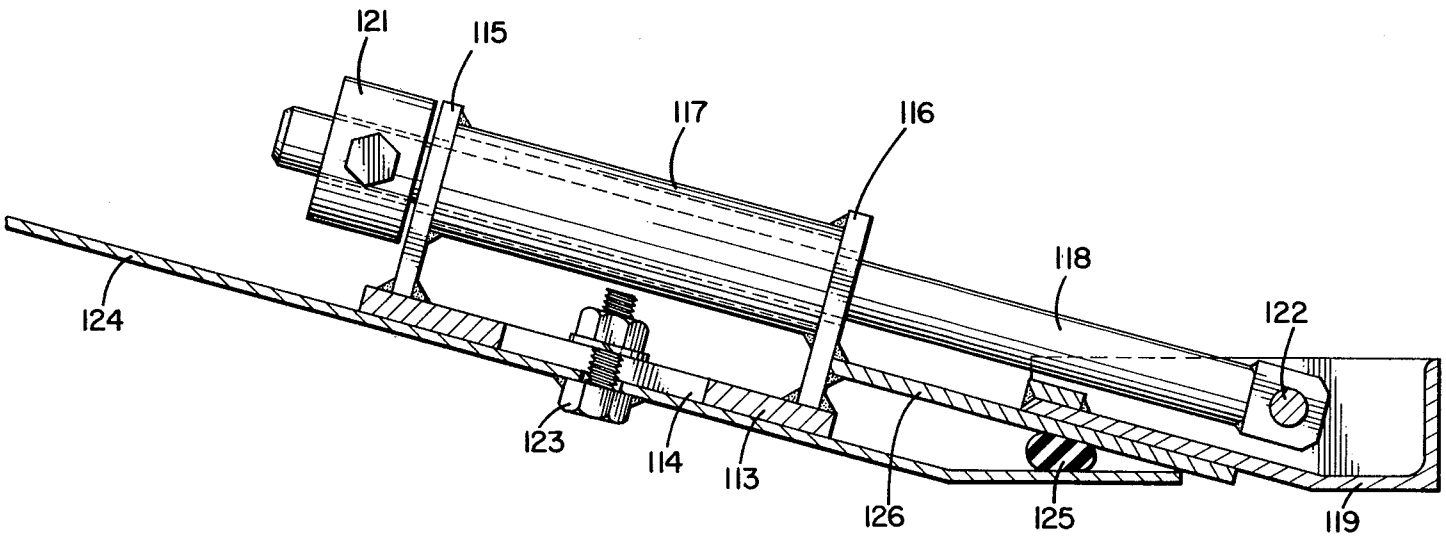
FIG. 3 is an enlarged detail of the upper, horizontal sealing arrangement.

The upper, horizontal sealing arrangement is shown in detail in FIG. 3. Sealing sheets 119 apply against the front surface of the coke oven, or the armor plates secured thereto. Upper cover sheet 124 is firmly screwed to the upper cross member 4 of coke guide 3. Holding plate 113 carrying cross webs 115,116 with guide tube 117 and actuating rod 118 etc., is connected to cover sheet 124 by a bolt 123. A slide sheet 126 for guiding sealing sheet 119 is in addition welded to front web 116. The upper cover sheet 124 is slightly bent adjacent its front end and sealed against slide surface 126 by a soft seal 125. Tension springs 20 are not shown in FIGS. 2 and 3, since they extend behind guide tube 117.

While specific embodiments of the invention have been shown and described in detail to illustrate the application of the principles of the invention, it will be understood that the invention may be embodied otherwise without departing from such principles.

LIST OF REFERENCE NUMERALS

1. Coke oven chamber (outer edge)
2. Anchor post
3. Coke guide
4. Upper cross member of 3
5. Power cylinder for displacing 3 in the direction of the coke oven
6. Track of 3, or outer wall of the coke guide car
7. Vertical braces
8. Upper horizontal beam
9. Vertical steel sections outside on 3
10. Sealing plate connected to 9

10*a*. Slide surface on 10

11. Resilient diaphragm screwed to 10
12. Contact piece for 11, connected to 7
13. Adjustable holding plate
14. Oblong slots
15. Rear web
16. Front web
17. Guide tube for 18
18. Actuating rod
19. Sealing sheet

20. Tension springs
21. Clamp for 20
**21*a*. Lever arm on 21**
22. Retaining bolt for 19 and 18
23. Lining of post

UPPER SEALING ARRANGEMENT

113. Adjustable holding plates
114. Oblong slots
115. Rear web
116. Front web
117. Guide tube for 118
118. Actuating rod
119. Sealing sheet
121. Clamp
122. Retaining bolt
123. Securing bolt
124. Upper cover sheet
125. Soft seal
126. Slide sheet

What is claimed is:

1. In combination with a coke oven chamber having an opening bounded by side anchor posts and a top member, all having outer surfaces, and a coke guide having side frame sections and an upper cross member connected between said side frame section and defining an inner space communicating with said coke oven chamber opening, a sealing arrangement comprising:

a fixed slide sheet connected to each side frame section and to said upper cross member;

a plurality of side sealing sheets for each side frame section and an upper sealing sheet for said upper cross member, each sealing sheet having one leg extending parallel to said outer surface of said anchor posts and top member, and another leg connected to said one leg and slidably engaged against one of said slide sheets;

an actuating rod connected to each sealing sheet, each actuating rod having one end connected to its respective sealing sheet and an opposite end mounted for sliding motion to said coke guide for movement of a respective sealing sheet toward and away from said outer surfaces; and a separate tension spring connected between each actuating rod and said coke guide for biasing each sealing sheet against one of said outer surfaces, each tension spring being positioned outside of said inner space and at a location spaced away from said outer surface and said sealing sheets.

2. The combination of claim 1, including a tube connected to said coke guide for each actuating rod, each actuating rod slidably mounted in its respective tube, a lever arm connected to each actuating rod at an end of each rod away from its respective sealing sheet, and a web connected to each tube and extending outwardly from each tube, each tensioning spring being connected between a respective lever arm and web for biasing a respective sealing sheet against a respective outer surface and, at the same time, applying torque to each sealing sheet for pressing said other leg of each sealing sheet against a respective slide sheet.

3. The combination of claim 2 including an adjustable holding plate mounted at an adjustable position to each side frame section and said upper cross member for each sealing sheet, a respective tube and slide sheet for each sealing sheet being connected to a respective adjustable holding plate.

4. The combination of claim 3 wherein said tensioning springs for biasing said side sealing sheets are mounted on the side of their respective tubes and actuating rods which are opposite from a respective slide sheet.

* * * * *